US006767167B1

(12) United States Patent
Rials

(10) Patent No.: US 6,767,167 B1
(45) Date of Patent: Jul. 27, 2004

(54) METHOD AND APPARATUS FOR LIFTING AND STABILIZING A FOUNDATION

(76) Inventor: Dennis Alan Rials, 1018 Fletcher, Dallas, TX (US) 75223

( * ) Notice: Subject to any disclaimer, the term of this patent is extended or adjusted under 35 U.S.C. 154(b) by 0 days.

(21) Appl. No.: 10/424,892

(22) Filed: Apr. 28, 2003

(51) Int. Cl.[7] ..... E02D 27/50; E02D 5/80

(52) U.S. Cl. ..... 405/244; 405/232; 52/125.1; 52/169.9

(58) Field of Search ..... 405/229–232, 405/239, 244, 249, 251; 52/169.9, 125.1, 126.7

(56) References Cited

U.S. PATENT DOCUMENTS

| | | | | |
|---|---|---|---|---|
| 4,634,319 | A | | 1/1987 | May |
| 4,678,373 | A | | 7/1987 | Langenbach, Jr. |
| 4,800,700 | A | | 1/1989 | May |
| 4,854,782 | A | | 8/1989 | May |
| 5,154,539 | A | | 10/1992 | McCown, Sr. et al. |
| 5,173,011 | A | | 12/1992 | Daniel, Jr. et al. |
| 5,205,673 | A | | 4/1993 | Bolin et al. |
| 5,234,287 | A | * | 8/1993 | Rippe, Jr. ..... 405/230 |
| 5,246,311 | A | | 9/1993 | West et al. |
| 5,492,437 | A | | 2/1996 | Ortiz |
| 5,722,798 | A | * | 3/1998 | Gregory ..... 405/230 |
| 5,724,781 | A | | 3/1998 | Matthias et al. |
| 5,951,206 | A | * | 9/1999 | Gregory ..... 405/230 |
| 6,142,710 | A | | 11/2000 | Holland, Jr. et al. |
| 6,193,442 | B1 | | 2/2001 | May |
| 6,468,002 | B1 | * | 10/2002 | Gregory et al. ..... 405/230 |

* cited by examiner

*Primary Examiner*—Robert E. Pezzuto
*Assistant Examiner*—Tara L. Mayo
(74) *Attorney, Agent, or Firm*—Winstead Sechrest & Minick; Henry L. Erhlich

(57) ABSTRACT

A method and apparatus for lifting and stabilizing a foundation including a pier having a top end and a bottom end, the pier being disposed in shaft drilled proximate the foundation to a desired underground formation suitable for supporting the foundation, a slab bracket connected to a side of the foundation and not supporting the foundation from the underside thereof, a jacking bracket attached to the top end of the prier and positioned below the slab bracket, and means for supporting the foundation positional between the jacking bracket and the slab bracket.

20 Claims, 2 Drawing Sheets

METHOD AND APPARATUS FOR LIFTING AND STABILIZING A FOUNDATION

The present invention relates in general to structural foundation repair and in particular to a method and apparatus for drilling a supporting pier to lift and support a structure from a foundation side.

BACKGROUND

Many types of structures, such as residential homes, commercial buildings and industrial equipment, are erected on foundations that are in turn supported by unstable soil rather than a load bearing formation such as rock. These foundations are typically concrete slabs and may include a footing that is wider than the foundation to spread the load of the foundation and carried structure. Ultimately the structural integrity and the level of the foundation and the carried structure are dependent on the stability of the underlying soil. Over time the stability of the underlying soil may change. These changes may include shifting of the soil and or subsidence of the underlying soil or portions of the supporting soil. Shifting of the soil may be caused by various geological and environmental conditions and/or the load carried by the structure. The changes in the supporting soil often result in damage to the structural integrity of the foundation and the carried structure and/or producing a non-level foundation. Left uncorrected the settling of the soil and lack of stability of the foundation may result in loss of part or all of the value of the foundation and carried structure. Due to the frequency of damage to foundations from soil settlement many systems have been attempted to stabilize the foundation and to correct positioning of the foundation.

The majority of methods and systems utilized to correct foundation damage is costly and often only provides a temporary solution or an incomplete solution. Many of the prior art foundation repair systems consist of driving piers into the underlying soil until refusal of insertion is attained. It is desired that the piers be driven until bedrock is reached or until the frictional resistance to driving of the pier corresponds to the compression weight of the supported structure. Once the piers are positioned in the ground hydraulic jacks are utilized to lift the foundation relative to the ground level. When the desired raised level is achieved the pier is connected to the foundation to secure the foundation in place, at least for the short term. Another constant aspect of the prior art foundation lifting systems is the utilization of brackets, or supports, that connect to the underneath side of the foundation. This positioning of the brackets on the underside of the foundation requires that a portion of the underlying soil be excavated from beneath the foundation.

In various situations it is necessary to raise and support the foundation within the perimeter of the foundation. Prior art methods and systems require cutting away a portion of the foundation and then excavating the soil from beneath the intact foundation to connect the lifting and supporting apparatus to the underside of the foundation. This additional excavation of the soil from beneath the intact foundation increases the time and cost of the project and increase the risk to workers as they position connections beneath the foundation.

Driving of piers, pilings or piles into the soil is a source of some of the most severe drawbacks of the prior art systems. Piers are typically driven into the ground utilizing a hydraulic mechanism until refusal and/or until the frictional resistance of the pier corresponds to the compression load of the foundation and structure. Very often bedrock is not encountered and the driven pier is supported by an unstable formation. It is also the case that the driven piers may pass through formations such as shale or other tight soils increasing the frictional force of driving the pier thereby providing misleading information as to contact with a suitable supporting formation. These geological formations may only provide temporary lifting and support of the foundation. Over time, changes in soil moisture content and other geological conditions may result in reduced or increased skin friction at the soil pier interface in these formations resulting in loss of stability from this formations.

Another problem with pier driving systems is maintaining a vertical alignment of the driven pier when the soil contains small boulders or other hard obstructions. As the pile is driven it may encounter several different soil formations and other material that will cause the pier to deviate from vertical. Piers may be twisted and even turned so that a portion extends horizontal relative to the intended pier path. These occurrences make it appear as though the pier has encountered a load bearing strata such as bedrock. The result being an expensive temporary solution or even another source of foundation problems.

Further, pier driven systems are limited on the diameter of pipe that may be used as a pier, thus decreasing the load strength of each pier. In addition, pier driven systems do not facilitate testing of the depth to the bedrock before driving the pier.

It is thus a desire to provide a method and apparatus for lifting and stabilizing a foundation that addresses some of these and other shortcomings of the prior art. It is a desire to provide a method and apparatus for lifting and stabilizing a foundation wherein a pier is placed in a substantially vertical position from a foundation to an underlying rock formation. It is a further desire to provide method and apparatus for lifting and stabilizing a foundation wherein a foundation may be lifted and stabilized from a periphery of the foundation. It is a still further desire to provide method and apparatus for lifting and stabilizing a foundation wherein lifting and supporting of a foundation may be from the edge of the foundation. It is a still further desire to provide a method and apparatus for lifting and stabilizing a foundation that does not require maintenance. It is a still further desire to provide a method and apparatus for lifting and stabilizing a foundation that does not require special soils be placed around the foundation to maintain its future performance. It is a still further desire to provide a method and apparatus for lifting and stabilizing a foundation that does not require drainage corrections around the foundation for performance.

SUMMARY OF THE INVENTION

In view of the foregoing and other considerations, the present invention relates to foundation repair wherein a foundation may be raised and stabilized from a stable geological formation, such as bedrock or other hard rock, without driving a pier.

It is a benefit of the present invention to provide a method and apparatus for lifting and stabilizing a foundation by drilling a hole from the foundation to a stable geological formation for placement of a pier.

It is a further benefit of the present invention to provide a method and apparatus for lifting and stabilizing a foundation from the periphery of the foundation.

It is a still further benefit of the present invention to provide a method and apparatus for lifting and stabilizing a foundation that does not require maintenance for continual support of a structure.

Accordingly, a method and apparatus for lifting and stabilizing a foundation is provided. The foundation and lifting system includes a pier having a top end and a bottom end, the pier being disposed in shaft drilled proximate the foundation to a desired underground formation suitable for supporting the foundation; a slab bracket connected to a side of the foundation and not supporting the foundation from the underside thereof, a jacking bracket attached to the top end of the pier and positioned below the slab bracket; and means for supporting the foundation positional between the jacking bracket and the slab bracket. This to rock support system prevents settling without regard to the supporting soil.

For brevity and clarity the present invention is described in relation to common residential and commercial structures supported on concrete slabs, and bedrock. However, it should be realized that the present invention may be applied to any structure or foundation, and any hard geological formation sufficient to support the structure may be utilized. For example, the present system and method may be utilized for construction and support of a deck or other structure proximate a hillside house adjacent a creek. A carbide bit may be used to drill a shaft into a rock formation at the bottom of the creek and the jacking bracket may be bolted to the wood beam to support the structure. Another example is utilization of the present invention is in the support of a retaining wall on a hillside experiencing slope failure. Utilizing the present invention the retaining wall is prevented from settling or sliding down the hill.

It is desirable to drill the shaft to an underground rock formation, such as bedrock, sufficient for stable and long term support of the foundation. Using a dirt drill bit a shaft is drilled to and into a geological formation until the formation does not allow a shaft to be created. Utilizing the dirt bit until drilling operations are prevented from making hole by the formation assures the acquisition of a formation suitable for support of the structure.

The pier, having a top end and a bottom end, is placed in the drilled shaft. It may be desired to clean any silt, cuttings or soughed material from the bottom of the hole before placement of the pier. It may be desired to drive the pier through any material at the bottom of the shaft. A cup may be connected to the bottom end of the pier to prevent the pier from cutting into the formation.

A slab bracket is provided for attachment to a side of the foundation to be supported. The side of the foundation may be exposed at the soil surface, by excavating soil from the perimeter of the foundation or cutting through the foundation. The present invention does not require support of the foundation from the underside of the foundation. The slab bracket is positioned above the drilled shaft and the positioned pier.

The slab bracket includes a face plate adapted for placement against the face of the foundation to be raised and a support plate extending outwardly from the face plate and foundation. The slab bracket may be connected to the foundation with bolts extending through the faceplate into the foundation. It may further be desired to utilize a cementing agent, such as an epoxy, to secure the bolts within the foundation. It may further be desired to have stabilizing legs positioned between the faceplate and the support plate of the slab bracket.

A jacking bracket is functionally connected to the top end of the pier and positioned below the support bracket of a slab bracket. The jacking bracket includes a shelf that may be connected by welding to a main post having a diameter for snugly disposing a portion of the top end of the pier therein. The jacking bracket may be connected to the pier in various manners including disposing a portion of the pier into the jacking bracket, welding the jacking bracket to the pier or threading the jacking bracket on the pier or a combination of methods. It is desirable to have a jacking bracket readily connectable to the pier after positioning the pier at a desired height. The current system desirably allows placement and securement of the pier in the shaft, and then a top portion of the pier may be removed at a level to attach the jacking bracket to achieve a sufficient spacing between the jacking and slab bracket for positioning of lifting and/or securement mechanisms.

It is desired to provide a space between the jacking and slab bracket for providing mechanisms for lifting and securing the foundation. The space provided allows the placement of a lifting mechanism such as, but not limited to, a hydraulic jack for raising the foundation to a desired location. Once the foundation is positioned in a desired location a supporting mechanism may be placed and/or connected between the jacking bracket and the slab bracket to maintain the foundation in a position relative to the supporting formation. The supporting mechanism may include concrete blocks and/or metal shims.

The present invention accomplishes placement of a pier between a foundation to be supported and a desired supporting ground formation by confirming existence of the supporting formation and the depth to the supporting formation. The present invention provides support a structure irrelevant of the characteristics of the soil or medium immediately underlying the structure.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
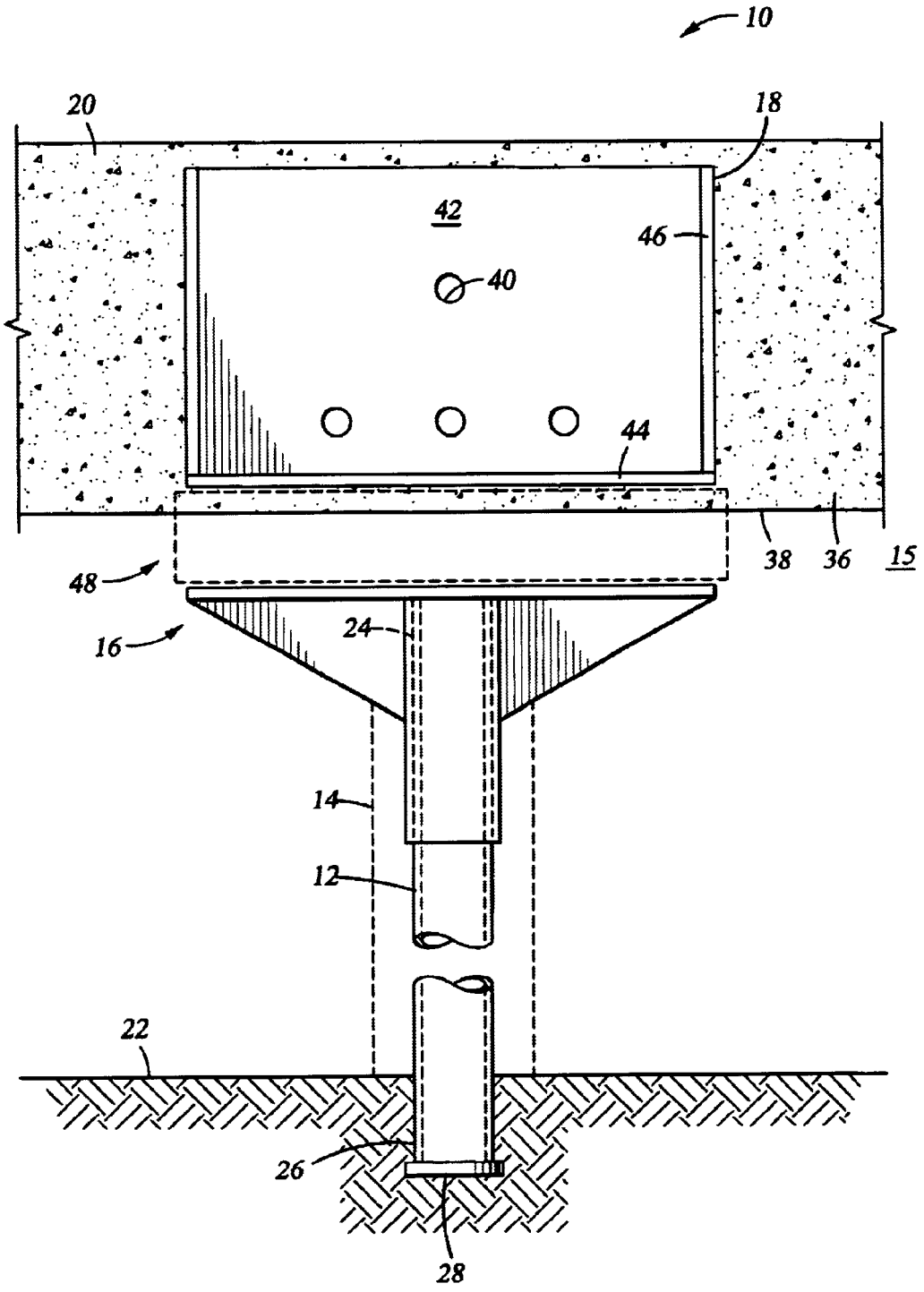
FIG. 1 is a schematic of the foundation lifting and supporting system of the present invention.

Refer now to the drawings wherein depicted elements are not necessarily shown to scale and wherein like or similar elements are designated by the same reference numeral through the several views.

FIG. 1 is a schematic drawing of the system for lifting and supporting foundation of the present invention generally designated by the numeral 10. System 10 includes a drilled pier 12, a jacking bracket 16 and a slab bracket 18.

Pier 12 is desirably a pipe having a sufficient length to reach from a foundation 20, such as a slab, to be raised and bedrock 22. Pier 12 is positioned in a drilled shaft 14 drilled from the surface of the soil into bedrock 22. Pier 12 may be a single stand of pipe or multiple connected stands of pipe connected by welding, threading or other known methods of connection. The schedule of pipe chosen is based on the load to be supported by pier 12. Unlike driven pier systems any desired diameter of pipe may be used. Pier 12 has a top end 24 and a bottom end 26. If may be desired to connect an end cap 28 to bottom end 26 of pier 12 to increase stability of pier 12 and to prevent pier 12 from cutting into bedrock 22.

Figure 3:
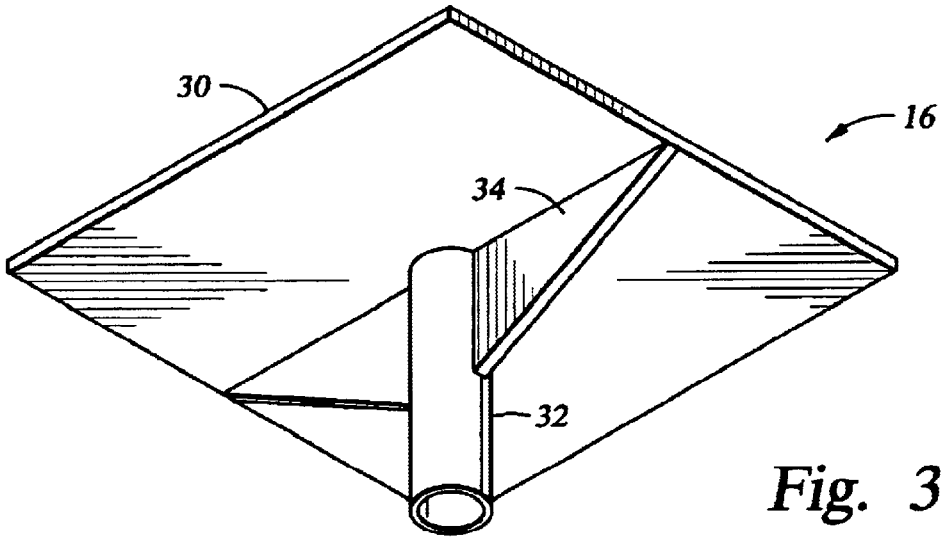
FIG. 3 is a perspective view of a jacking bracket of the present invention.

As will be more readily understood throughout the description, the jacking bracket of the present invention can be constructed in varying embodiments for the particular project. An embodiment of jacking bracket 16, shown in detail in FIG. 3, is connected to top end 24 of pier 12 for supporting a lifting mechanism for lifting foundation 20. With additional reference to FIG. 3 jacking bracket 16 is shown having a shelf 30, main post 32 and gussets 34. Shelf 30 is desirably constructed of a metal sheet having sufficient strength to lift a portion of foundation 20 and any carried structure without substantial deformation. Support post 32 is connected to and extends downward from the center point of the underside of shelf 30 for connecting to pier 12 and to transfer the load carried on shelf 30 to pier 12. To increase the strength and stability of shelf 30 gussets 34 may be connected between support post 32 and shelf 30.

Jacking bracket 16 is connected atop pier 12 to provide a surface for lifting slab 20 and transferring the load to pier 12 and to bedrock 22. In a preferred embodiment support post 32 has a diameter sufficient to dispose top end 24 and a portion of pier 12 therein. Jacking bracket 16 may be further secured to pier 12 by tack welding or other methods. This type of connection permits the cutting off of a portion pier 12 to a desired length and providing a stable connection between pier 12 and jacking bracket 16. Other methods of connecting jacking bracket 16 to pier 12 without departing from the scope of the invention may be utilized.

Slab bracket 18 is adapted to be connected to a side 36 of slab 20 and in a preferred embodiment is not connected to the underside 38 of slab 20. Side 36 of slab 20 may be the periphery of slab 20 or a portion of slab 20 cut away. Slab bracket 18 is connected to slab 20 utilizing anchoring bolts 40. It is desirable to secure anchoring bolts 40 with an adhesive such as Hilti HIT HY-150, a fast curing two-part adhesive anchor system for concrete.

Figure 2:
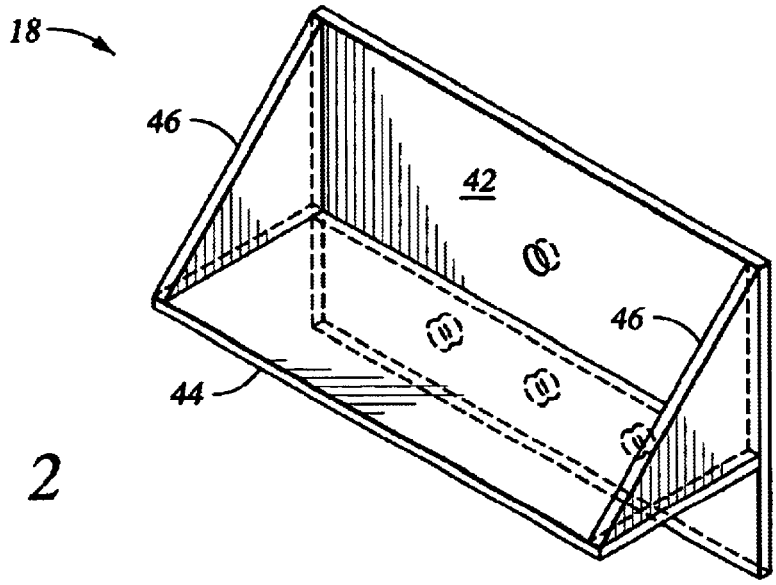
FIG. 2 is a perspective view of a slab bracket of the present invention.

With reference to FIGS. 1 and 2 varying embodiments of slab bracket 18 are shown. Slab bracket 18 includes a face plate 42, support plate 44 and a pair of legs 46. Face plate 42 is a substantially vertical member for disposing on slab side 36. Support plate 44 extends substantially horizontally away from face plate 42. Support plate 44 is adapted to be connected to jacking plate 16 by lifting mechanisms during the lifting operations and by support mechanisms after lifting operations are completed. Lifting and supporting mechanisms are not shown in detail but are generally designated by the box labeled 48. Support plate 44 may further be strengthened by legs 46. As shown in FIGS. 1 and 2, support plate 44 may be extend from face plate 42 in varying locations to facilitate the transfer of load from slab 20 to pier 12 and directing the forces into slab 20 as opposed to pushing bracket 18 away from slab 20.

Figure 4:
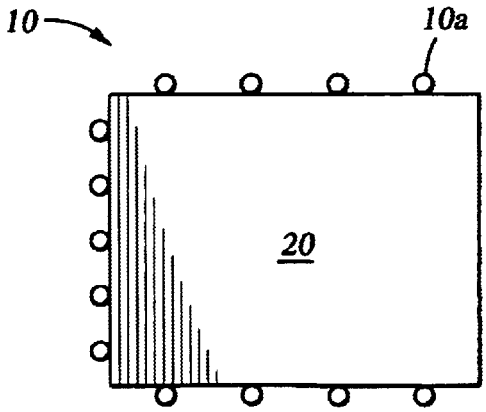
FIG. 4 is a schematic of an example of the foundation lifting and supporting system.

FIG. 4 is schematic of a foundation lifting and support method and system of the present invention. System 10 was utilized in a limited access manufacturing facility wherein there were both vertical and horizontal space limitations and an extremely heavy load requirement. Slab 20 is an interior foundation for equipment requiring lifting and leveling. The depth to rock 22 was twelve feet and slab 20 is four feet thick. Thirteen individual systems 10*a* are shown spaced around the periphery of slab 20. Four inch shafts 14 were drilled spaced approximately six feet apart. Eleven of the systems 10*a* utilized 2¾ inch pipe for piers 12 and two of the systems utilized 3 inch pipe for piers 12. Jacking brackets 16 were constructed to correspond to the appropriate pier 12 size. Slab brackets 18 were fabricated for a 4 feet thick slab 20. The estimated lifting weight per pier was 35,000 pounds.

A method of lifting and supporting a foundation is now described with reference to FIGS. 1 through 4. A foundation 20 is evaluated to determine the remedial action that must be taken such as lifting and leveling. The load to be lifted and the thickness of the foundation is determined. Locations for piers 12 are determined. If a pier 12 is to be positioned within the perimeter of slab 20, a hole is cut through slab 20 to expose slab side 36 and the underlying soil. A portion of soil 15 is excavated so as to expose slab side 22 and to a depth and width sufficient for drilling and placement of jacking bracket 16 and slab bracket 18. A hole or shaft 14 is drilled, substantially vertically, from the surface of the soil 15 to bedrock 22 or other desired supporting formation. It is desirable to drill shaft 14 partially into formation 22 utilizing a dirt bit until creation of a shaft is prevented by the foundation. It may be determined that the desired formation 14 has been encountered by viewing and/or testing the cuttings removed from shaft 14 and by prevention of drilling by the formation. Once the total depth of shaft 14 is achieved it is desirable to remove the debris in shaft 14. Pipe is run into shaft 14 to form a pier 12. The pier may be driven through the silt and material in the bottom of shaft 14. It may be desired to connect an end cap to the bottom end 26 of pier 12 to prevent pier 12 from cutting into formation 22. Pier 12 can then be leveled and secured, such as by back fill, in shaft 14. A portion of the top end 24 of pier 12 may be cut to achieve the desired height of pier 12.

Jacking bracket 16 is connected to top end 24 of pier 12 by disposing support post 32 over pier 12. Jacking bracket 16 may be further secured to pier 12.

Slab bracket 18 is connected to slab side 36 by anchoring bolts 40 and desirably with an adhesive to further secure bolts 40 depending on the foundation material. Slab bracket 18 is connected so that support plate 44 extends out from slab side 36 and is positioned over shelf 30 of jacking bracket 16.

A lifting mechanism 48, such as a hydraulic jack, is placed between shelf 30 of jacking bracket 16 and support plate 44 of slab bracket 16. Lifting mechanism 48 is operated until slab 20 has been raised to the desired level. Once the desired restoration of foundation 20 is achieved the lifting mechanisms may be replaced with support mechanisms 48. The system and method of the present invention provides a stable and secure support between a desired supporting formation 22.

From the foregoing detailed description of specific embodiments of the invention, it should be apparent that a method and system for lifting and supporting a foundation has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. For example, a slab is not limited to a concrete foundation but may include a wood, steel or other type of supporting structure.

What is claimed is:

1. A system for lifting and supporting a foundation, said system comprising:

a pier having a top end and a bottom end, said pier disposed in a drilled shaft between an underground formation and a foundation to be supported;

a slab bracket connected to a side of said foundation, wherein said slab bracket is not contacting the underside of the foundation directed toward the underground formation for purposes of supporting the foundation;

a jacking bracket attached to said top end of said pier and positioned below said slab bracket; and means for supporting the foundation positional between said jacking bracket and said slab bracket.

2. The system of claim 1 further including an end cap connected to said bottom end of said pier.

3. The apparatus of claim 2 wherein said slab bracket includes a face plate adapted for connection to said side of said foundation and a support plate extending outward from said face plate and away from said foundation.

4. The system of claim 1 wherein said means for supporting the foundation includes a lifting mechanism.

5. The system of claim 4 wherein said means for supporting the foundation includes supporting mechanisms for maintaining said pier and said slab bracket within a spaced relationship from one other.

6. The apparatus of claim 5 wherein said slab bracket includes a face plate adapted for connection to said side of said foundation and a support plate extending outward from said face plate and away from said foundation.

7. The apparatus of claim 4 wherein said slab bracket includes a face plate adapted for connection to said side of said foundation and a support plate extending outward from said face plate and away from said foundation.

8. The system of claim 1 wherein said means for supporting the foundation includes supporting mechanisms for maintaining said pier and said slab bracket within a spaced relationship from one other.

9. The apparatus of claim 8 wherein said slab bracket includes a face plate adapted for connection to said side of said foundation and a support plate extending outward from said face plate and away from said foundation.

10. The apparatus of claim 1 wherein said slab bracket includes a face plate adapted for connection to said side of said foundation and a support plate extending outward from said face plate and away from said foundation.

11. A method of lifting and supporting a foundation comprising the steps of:

drilling a shaft proximate a foundation from a soil surface to a selected subsurface formation;

positioning a pier, having a top end and a bottom end, within said drilled shaft;

connecting a jacking bracket on said top end of said pier;

connecting a slab bracket to a side of the foundation, said slab bracket positioned above said jacking bracket and wherein said slab bracket is not contacting the underside of the foundation directed toward the underground formation for purposes of supporting the foundation;

lifting the foundation to a selected position via means for lifting positioned between said jacking bracket and said slab bracket; and supporting the foundation in the selected position via supporting means placed in connection between said jacking bracket and said slab bracket.

12. The method of claim 11 wherein said subsurface formation is bedrock.

13. The method of claim 12 wherein said shaft is drilled partially into said bedrock.

14. The method of claim 13 wherein said slab bracket includes a face plate adapted for connection to said foundation and a support plate extending outward from said face plate and away from said foundation.

15. The method of claim 12 wherein said slab bracket includes a face plate adapted for connection to said side of said foundation and a support plate extending outward from said face plate and away from said foundation.

16. The method of claim 11 where in said shaft is drilled partially into said subsurface formation.

17. The method of claim 16 wherein said slab bracket includes a face plate adapted for connection to said foundation and a support plate extending outward from said face plate and away from said foundation.

18. The method of claim 11 wherein said slab bracket includes a face plate adapted for connection to said side of said foundation and a support plate extending outward from said face plate and away from said foundation.

19. A method of lifting and supporting a foundation comprising the steps of:

drilling a shaft proximate a foundation from a soil surface to a subsurface bedrock;

positioning a pier, having a top end and a bottom end, within said drilled shaft substantially perpendicular between the foundation and said bedrock;

connecting a jacking bracket on said top end of said pier;

connecting a slab bracket to a side of the foundation and not positioned along the underside of the foundation, said slab bracket positioned above said jacking bracket;

lifting the foundation to a selected position via means for lifting positioned between said jacking bracket and said slab bracket; and supporting the foundation in the selected position via supporting means placed in connection between said jacking bracket and said slab bracket.

20. The method of claim 19 wherein said slab bracket includes a face plate adapted for connection to said side of said foundation and a support plate extending outward from said face plate and away from said foundation.

* * * * *